United States Patent [19]

Fleischer

[11] Patent Number: 4,778,184

[45] Date of Patent: Oct. 18, 1988

[54] MULTI-DIMENSIONAL SCULPTURE PUZZLE/TOY

[76] Inventor: Howard J. Fleischer, 67-11 Yellowstone, Apt. 6-E, Forest Hills, N.Y. 11375

[21] Appl. No.: 66,516

[22] Filed: Jun. 26, 1987

[51] Int. Cl.[4] ..... A63F 9/08

[52] U.S. Cl. ..... 273/155; 446/487; 446/490

[58] Field of Search ..... 273/155, 159, 58 D; 446/487, 490

[56] References Cited

U.S. PATENT DOCUMENTS 3,695,617 10/1972 Mogilner et al. ..... 273/156
3,900,984 8/1975 Garelick ..... 446/487 X
3,916,559 11/1975 Flowerday ..... 273/155 X
4,274,222 6/1981 Zahn et al. ..... 273/58 D X

FOREIGN PATENT DOCUMENTS

WO83/01393 4/1983 PCT Int'l Appl. ..... 273/155
23287 of 1893 United Kingdom ..... 273/159

*Primary Examiner*—Anton O. Oechsle
*Attorney, Agent, or Firm*—John J. Byrne

[57] ABSTRACT

This puzzle device is constructed for recreation, amusement and educational purposes. Primarily, it consists of a multiple number of tubes that are joined together by a cord that is exposed at the ends of the tubes to serve as hinges for manipulating the device to form various geometric shapes, such as, a cube, a square, a hexagonal form, a rectangle, a four sided pyramid, a three sided pyramid, etc.

4 Claims, 1 Drawing Sheet

MULTI-DIMENSIONAL SCULPTURE PUZZLE/TOY

BACKGROUND OF THE INVENTION

The instant invention relates generally to construction toys, and more particularly, to a multi-dimensional sculpture puzzle/toy.

Numerous puzzle toys have been provided in the prior art that are adapted to provide amusement, etc. For example, U.S. Pat. No. 4,271,628 to Barlow, is illustrative of such prior art. While this one patent may be suitable for the particular purpose to which it addresses, it would not be as suitable for the purpose of the present invention as hereafter described.

SUMMARY OF THE INVENTION

A primary object of the present invention is to provide a multi-dimensional sculpture puzzle/toy that will overcome the shortcomings of the prior art devices.

Another object is to provide a multi-dimensional sculpture puzzle/toy, which will be educational and also provide recreation for young and old.

An additional object is to provide a multi-dimensional sculpture puzzle/toy, which will enable one to construct various geometric forms, such as cubes, pyramids, etc. This invention may also be fabricated of a variety of materials and each tube thereof may range from four inches to many feet, and it may be employed in art/sculpture, teaching, etc.

A further object is to provide multi-dimensional sculpture puzzle/toy that is simple and easy to use.

A still further object is to provide a multi-dimensional sculpture puzzle/toy that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
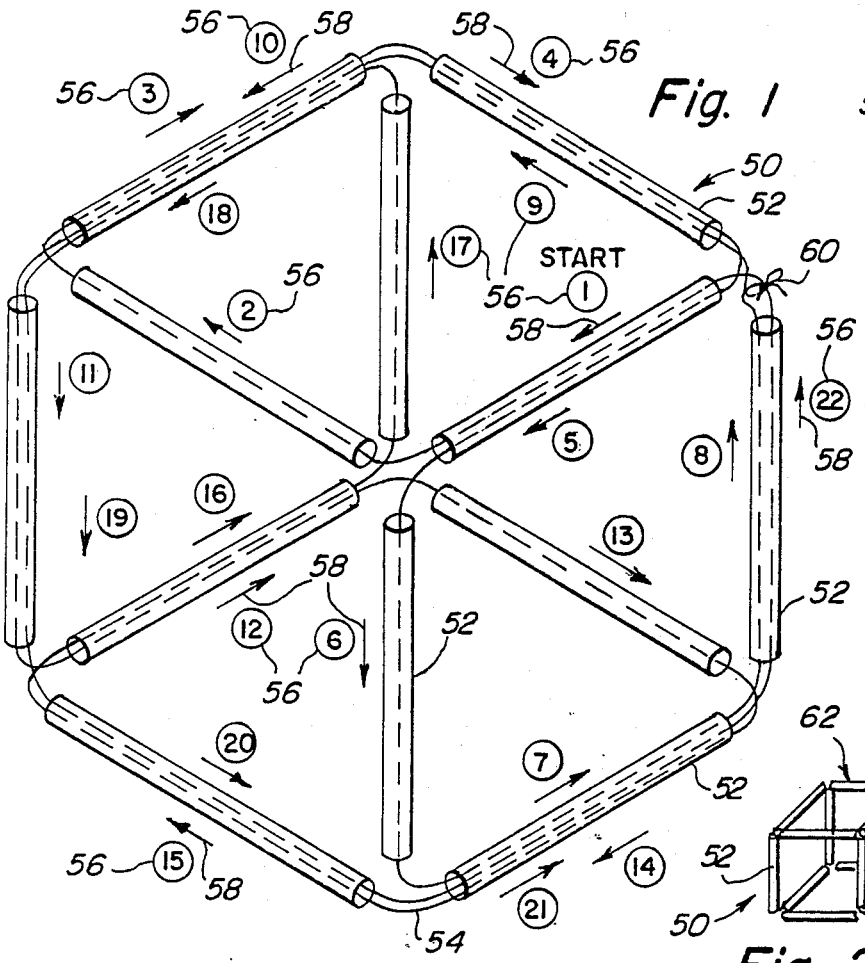
FIG. 1 is a diagrammatic perspective view of the instant invention, showing the device as a cube with the tubes spread apart in order to better illustrate the path of the string thereof, with twenty-two threadings.

Turning now descriptively to the drawings, in which like reference characters denote like elements throughout the several views, a device 50 is shown to include a plurality of rigid tubes 52 that are twelve in number and made of any suitable material. A flexible cord or semi rigid wire string member 54 is provided and strung through tubes 52 as illustrated in FIG. 1, for connecting tubes 52 and hinging same together.

It shall be noted that the balloons 56 with numerical characters therein alongside of arrows 58, are not to be associated with the customary numerical characters of leaders employed throughout the specification for describing the various elements of device 50, as the balloons 56 are merely a manner of indicating the direction of flow of the stringing of cord 54.

Accordingly, the start of cord 54 feed is indicated by the number one balloon 56 and arrow 58, and the finish of the stringing is indicated by the number twenty-two balloon and its associated arrow 58, the ends of cord 54, being tied by knot 60 externally of tubes 52. When packaged (not shown), the tubes 52 are in parallel engagement with each other. Cord 54 passes through some tubes 52 once, some tubes 52 twice and some tubes 52 three times.

Figure 3:
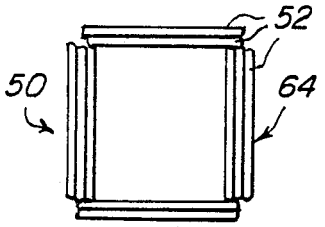
FIG. 3 is a reduced perspective view illustrating the device structured as a square.
Figure 4:
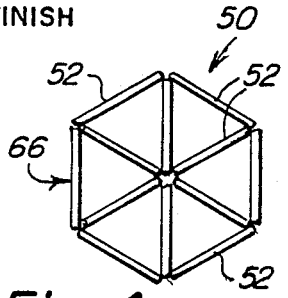
FIG. 4 is a reduced perspective view illustrating the device structured as a hexagon.
Figure 2:
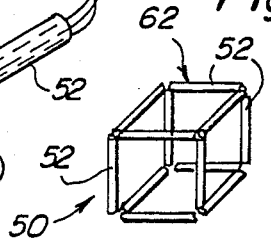
FIG. 2 is a reduced perspective view illustrating the device structured as a cube.
Figure 5:
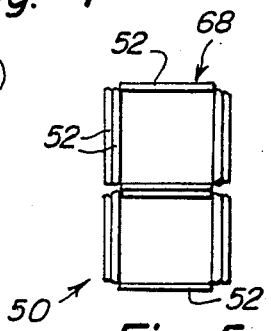
FIG. 5 is a reduced perspective view illustrating the device structured as a rectangle.

In use, device 50 is formed into a cube 62 by manipulation of the tubes 52, as shown in FIG. 2 of the drawing. In a similar manner, tubes 52 are formed into a square 64 as illustrated in FIG. 3, and in such an arrangement, tubes 52 are in parallel engagement in forming the sides of square 64. In similar fashion a hexagon 66 is formed as seen in FIG. 4, and in FIG. 5, a rectangle 68 is formed, the sides of 68 including pairs of parallel tubes 52.

Figure 6:
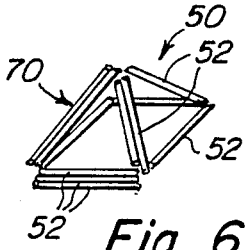
FIG. 6 is a reduced perspective view illustrating the device structured as a pyramid with a four sided base.
Figure 7:
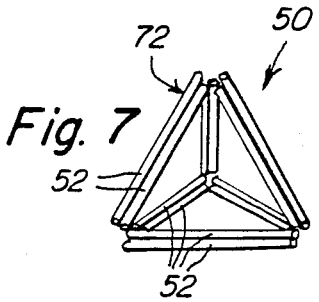
FIG. 7 is a reduced perspective view illustrating the device structured as a pyramid with a three sided base.

Again in use, a pyramid 70 is formed with a four sided base as is seen in FIG. 6, and a pyramid 72 with a three sided base is formed, as illustrated in FIG. 7.

It shall also be noted, that it is obvious that many other two-dimensional and three-dimensional figures may be formed with device 50 that are not shown. Device 50 is provided with twenty-two stringings.

Figure 8:
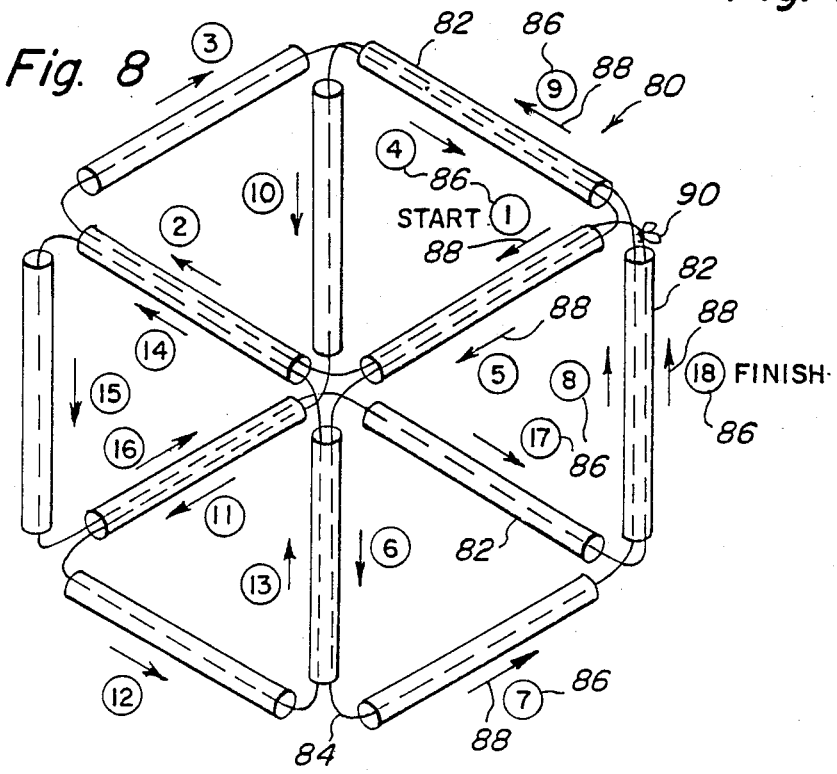
FIG. 8 is similar to FIG. 1 but illustrates a modified form of the device with eighteen threadings.

Referring now to FIG. 8, a modified device 80 is shown to include semi-rigid tubes 82 that are twelve in number, and like device 50 in FIG. 1, a cord 84 is provided and similar balloons 86 with arrows 88, as was described of device 50 provide for indicating the direction of flow of cord 84. In this instance, the balloons 86 indicate that modified device 80 is strung eighteen times rather than twenty-two, as described of device 50, and a knot 90 is tied in the ends of the cord 84.

In use, device 80 functions in the same manner described of device 50, meaning, that the same forms as illustrated in FIGS. 3 through 7 may be effected, as well as other forms.

It shall also be recognized that an infinite number of ways of stringing devices 50 and 80 may be effected, other than twenty-two and eighteen as described.

Even further, when packaged, device 50 may include a booklet showing the many shapes, designs, letters and numbers, that may be formed.

What is claimed is:

1. A puzzle device comprising:

a plurality of tube members;

string means disposed within said tube members and linking the ends of said tube members together; and wherein said string means comprises means to flexibly attach each of said tube members in proximate hinged contact with two other of said tube members at each end thereof.

2. The puzzle device of claim 1 wherein said tube members are equal in length and twelve in number.

3. The puzzle device of claim 1 wherein said tube members are pivotably manipulable to form such shapes comprising a cube, a square, a hexagon, a rectangle, a four-sided pyramid, and a three-sided pyramid.

4. The puzzle device of claim 1 wherein the string means is disposed within some of the tubes only once, some of the tubes twice and some of the tubes three times.

* * * * *